US009238288B2

(12) United States Patent
Sugiya et al.

(10) Patent No.: US 9,238,288 B2
(45) Date of Patent: Jan. 19, 2016

(54) METHOD FOR PROCESSING PLATE OBJECT

(71) Applicant: Disco Corporation, Tokyo (JP)

(72) Inventors: Tetsukazu Sugiya, Tokyo (JP); Susumu Hayakawa, Tokyo (JP)

(73) Assignee: Disco Corporation, Tokyo (JP)

( * ) Notice: Subject to any disclaimer, the term of this patent is extended or adjusted under 35 U.S.C. 154(b) by 67 days.

(21) Appl. No.: 14/104,761

(22) Filed: Dec. 12, 2013

(65) Prior Publication Data

US 2014/0183163 A1 Jul. 3, 2014

(30) Foreign Application Priority Data

Dec. 27, 2012 (JP) ..... 2012-284294

(51) Int. Cl.
*B44C 1/22* (2006.01)
*B24B 1/00* (2006.01)
*B24B 7/04* (2006.01)

(52) U.S. Cl.
CPC .... *B24B 1/00* (2013.01); *B24B 7/04* (2013.01)

(58) Field of Classification Search
CPC ..... H01L 21/02013; H01L 21/02024; H01L 21/304; B24B 7/04; B24B 1/00
USPC ..... 216/52; 438/691
See application file for complete search history.

(56) References Cited

U.S. PATENT DOCUMENTS 5,821,166 A * 10/1998 Hajime et al. ..... 438/691
6,656,818 B1 * 12/2003 Kishimoto ..... 438/459

FOREIGN PATENT DOCUMENTS

JP 2004-221175 8/2004
JP 2012-106293 6/2012

* cited by examiner

*Primary Examiner* — Roberts Culbert
(74) *Attorney, Agent, or Firm* — Greer Burns & Crain Ltd.

(57) ABSTRACT

In a method for processing a plate object, etching is performed for a flat plate object by a predetermined etching method and the shape of the plate object after the etching is grasped in advance. In a grinding step, the plate object is ground into a grinding-finished shape that is a non-flat shape obtained by inverting the shape of the plate object after the etching to the reverse shape. When subsequent etching by the predetermined etching method is performed for a grinding-target surface, the plate object is formed into a flat shape with a uniform thickness.

3 Claims, 7 Drawing Sheets

METHOD FOR PROCESSING PLATE OBJECT

BACKGROUND OF THE INVENTION

1. Field of the Invention

The present invention relates to a method for processing a plate object or a plate-shaped workpiece in which the plate object is ground and then the grinding-target surface is etched.

2. Description of the Related Art

For example a semiconductor wafer, an optical device wafer, or the like on which a large number of devices are formed on the front surface is thinned to a predetermined thickness by grinding of the back surface and thereafter is subjected to division processing into each device. In some cases, after the grinding, the grinding-target surface is etched in order to eliminate grinding distortion generated by the grinding (refer to Japanese Patent Laid-open No. 2004-221175 and Japanese Patent Laid-open No. 2012-106293).

SUMMARY OF THE INVENTION

However, because of variation in the etching rate in the plane of the grinding-target surface of the etched plate object, the plate object after the etching is often not flat. Furthermore, the etching rate differs depending on the kind of etchant, the etching condition, and so forth. It is very difficult to manage the etching rate in the plane of the grinding-target surface and therefore there is a problem that it is difficult to process a plate object into a desired shape by etching.

It is therefore an object of the present invention to provide a method for processing a plate object allowing even a plate object after etching to be flatly formed.

In accordance with an aspect of the present invention, there is provided a method for processing a plate object. The method includes the steps of: grinding a plate object held by a holding table having a holding surface to hold the plate object by a grinding unit having a grinding stone to thin the plate object to a predetermined thickness, and etching a grinding-target surface of the plate object after carrying out the grinding. In the grinding step, the plate object is formed into a non-flat shape in consideration of an etching state in the etching so that the plate object may become flat after the etching is carried out.

In the processing method of the aspect of the present invention, the plate object after the etching is flatly formed because the plate object is formed into a non-flat shape in consideration of the etching state in the etching so that the plate object may become flat after the etching is carried out.

Preferably, the processing method of the aspect of the present invention includes a mode in which, in the grinding step, the plate object is formed into the non-flat shape by performing grinding while making the grinding stone abut against the plate object held by the holding table in a state in which the holding surface of the holding table that holds the plate object and a grinding surface of the grinding stone are relatively inclined to be set non-parallel to each other.

The method for processing a plate object in accordance with the aspect of the present invention further includes the steps of: performing pre-etching for the grinding-target surface of the plate object that is flat prior to the grinding, and checking the shape of the plate object after the pre-etching, and calculating a grinding-finished shape with which the plate object becomes flat after the etching based on the checked shape of the plate object after the pre-etching. In the grinding step, the plate object is ground into the calculated grinding-finished shape.

Preferably, the plate object has a circular disc shape and the sectional shape of the plate object checked in the checking is either a double-concave shape in which the periphery of the center of the plate object has a concave shape or a double-convex shape in which the periphery of the center of the plate object has a convex shape. The sectional shape of the plate object is so formed as to become the double-convex shape in which the periphery of the center of the plate object has a convex shape in the grinding, if the sectional shape of the plate object checked in the checking is the double-concave shape in which the periphery of the center of the plate object has a concave shape. The sectional shape of the plate object is so formed as to become the double-concave shape in which the periphery of the center of the plate object has a concave shape in the grinding, if the sectional shape of the plate object checked in the checking is the double-convex shape in which the periphery of the center of the plate object has a convex shape.

The aspect of the present invention offers an effect that a method for processing a plate object allowing even a plate object after etching to be flatly formed is provided.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
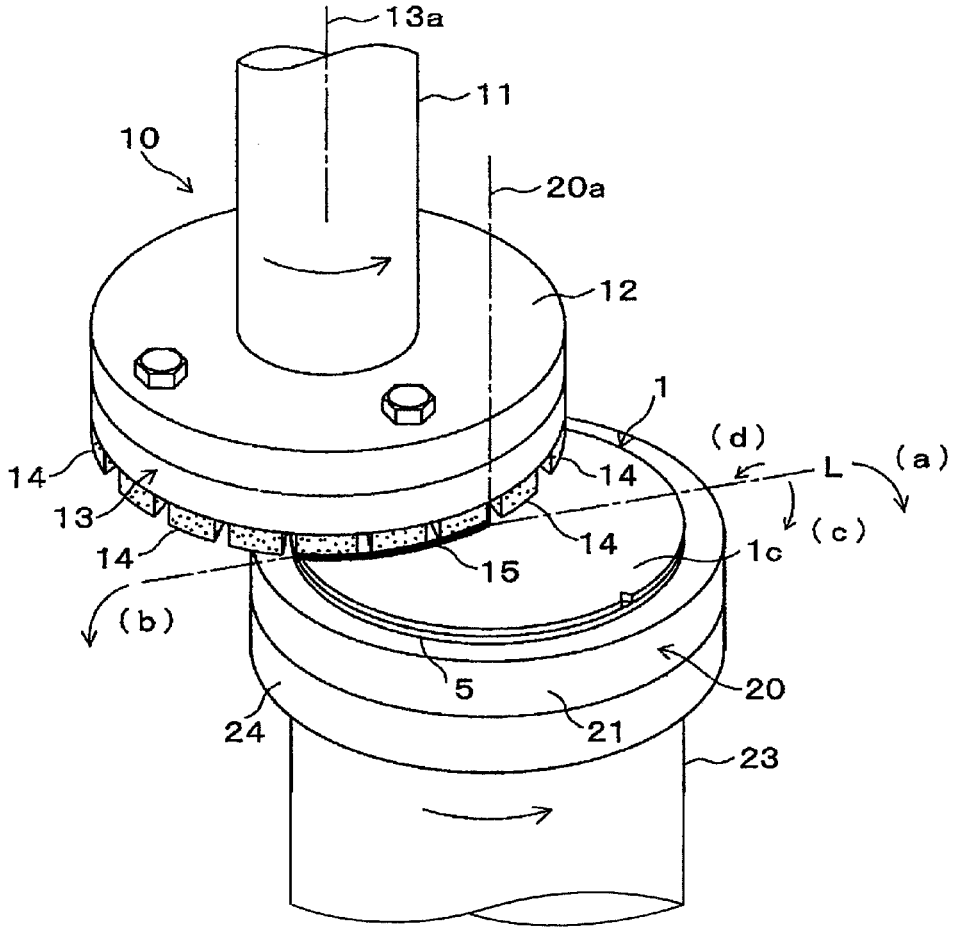
FIG. 1 is a perspective view showing the major part of grinding apparatus to carry out a grinding step of a processing method according to one embodiment of the present invention.

One embodiment of the present invention will be described below with reference to the drawings. FIG. 1 shows the major part of grinding apparatus capable of favorably carrying out a processing method of one embodiment. This grinding apparatus includes a holding table 20 that holds a plate object or a plate-shaped workpiece 1 with a circular disc shape on the upper surface and a grinding unit 10 that is disposed over the holding table 20 and grinds the plate object 1 held by the holding table 20.

The plate object 1 is a substrate material with a thickness of e.g. several hundreds of micrometers, such as a semiconductor wafer or an optical device wafer on which a large number of devices are formed on the front surface. It is thinned to a predetermined thickness by grinding of the back surface, on which devices are not formed. For the plate object 1 after the grinding, etching needs to be performed for a grinding-target surface 1*c* by a predetermined method in order to eliminate grinding distortion generated by the grinding.

[1] Grinding Apparatus

As shown in FIG. 1, the grinding unit 10 is a component made by fixing a grinding wheel 13 to the tip of a spindle 11 that extends along the vertical direction and is rotationally driven by a motor (not shown) with the intermediary of a mount flange 12. The grinding unit 10 is vertically movably disposed over the holding table 20. At the outer circumferential part of the lower surface of the grinding wheel 13, a large number of grinding stones 14 are arranged in an annular manner and are fastened. As the grinding stone 14, one suitable for the material of the plate object 1 is used. For example, a diamond grinding stone formed by binding abrasive grains of diamond by a binding agent such as a metal bond or a resin bond is used.

Figure 2:
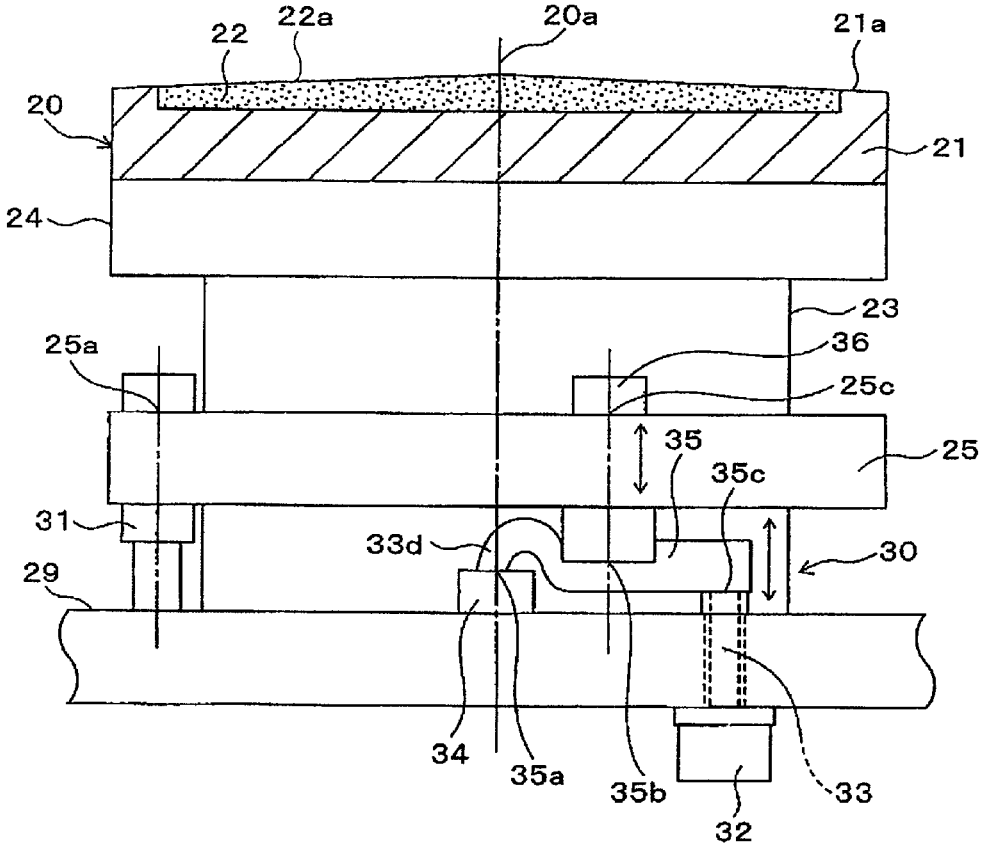
FIG. 2 is a side view showing a holding table and an inclination angle adjuster of the grinding apparatus.

As shown in FIG. 2, the holding table 20 is a component made by fitting a holding part 22 that is formed of a porous body and has a circular disc shape to an upper surface 21*a* of a frame body 21 that is formed of a metal such as stainless steel and has a circular disc shape. The holding table 20 is a vacuum chuck that sucks and holds the plate object 1 on a holding surface 22*a* as the upper surface of the holding part 22 by a negative pressure effect by air suction.

The holding surface 22*a* of the holding part 22 is formed into a substantially umbrella shape that has the peak point at its center and has a downward slope at a minute angle (e.g. 0.0001 to 0.001°) toward the outer circumferential edge. The upper surface 21*a* of the frame body 21 around the holding surface 22*a* is so inclined as to be flush with the holding surface 22*a*. A protective component 5 is attached to the front surface side of the plate object 1 according to need as shown in FIG. 1 and the plate object 1 is disposed over the holding surface 22*a* concentrically with the intermediary of the protective component 5 with the grinding-target surface 1*c* exposed upward. When being sucked and held, the plate object 1 is deformed into an umbrella shape in accordance with the holding surface 22*a* and becomes a state of being brought into tight contact with the holding surface 22*a*. In the drawings other than FIG. 1, diagrammatic representation of the protective component 5 is omitted.

The holding table 20 is fixed on a rotating plate 24 rotatably supported on a cylindrical base 23. The frame body 21 of the holding table 20 and the rotating plate 24 have the same outer diameter and are provided concentrically with the cylindrical base 23. A drive mechanism including a motor to rotate the rotating plate 24 is housed (not shown) in the cylindrical base 23 and the holding table 20 rotates with the rotating plate 24 by actuation of this drive mechanism. On the outer circumferential surface of the cylindrical base 23, a flange part 25 having the same outer diameter as the holding table 20 and the rotating plate 24 is formed.

Figure 3:
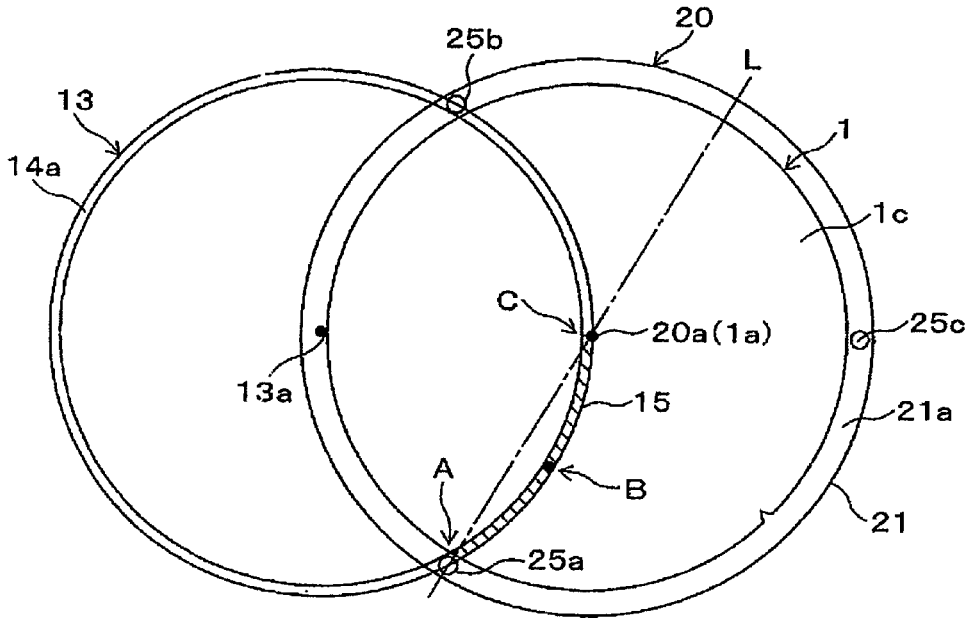
FIG. 3 is a plan view showing the positional relationship among a grinding wheel possessed by a grinding unit of the grinding apparatus, a plate object held by the holding table, and the inclination angle adjuster.

FIG. 3 shows the positional relationship between the grinding wheel 13 and the plate object 1 held by the holding table 20. A grinding surface 14*a* by the lower surfaces of the grinding stones 14 of the grinding wheel 13 that rotates forms a horizontal annular shape and the outer diameter of this horizontal annular grinding surface 14*a* is equivalent to or slightly larger than that of the plate object 1. The outer diameter of the grinding surface 14*a* of the grinding stones 14 is so set that the outer circumferential edge of the grinding surface 14*a* passes through a rotation axis 20*a* of the holding table 20, i.e. a rotation center 1*a* of the plate object 1. Due to this, the region in which the grinding stones 14 get contact with and grind the plate object 1 held on the holding surface 22*a* is limited to a processing region 15 (shown by a heavy line in FIG. 1 and by hatched lines in FIG. 3) with a circular arc shape from the rotation center 1*a* to the outer circumferential edge of the plate object 1.

As shown in FIGS. 2 and 3, in the above-described flange part 25, one fixed support part 25*a* and two movable support parts 25*b* and 25*c* are set. These support parts 25*a* to 25*c* are disposed at positions equally separated from each other in the circumferential direction. As shown in FIG. 2, at the fixed support part 25*a*, a fixed shaft 31 fixed on an apparatus pedestal 29 penetrates the flange part 25. This fixed shaft 31 is fastened to the flange part 25 by a bolt stopper or the like. The respective movable support parts 25*b* and 25*c* are vertically moved by an inclination angle adjuster 30 with the fixed support part 25*a* serving as the fulcrum. This tilts the holding table 20 with the cylindrical base 23. That is, the cylindrical base 23 is supported over the apparatus pedestal 29 with the intermediary of the inclination angle adjuster 30 in such a manner that the angle of its center axis can be tilted. The center axis of the cylindrical base 23 corresponds with the rotation axis 20*a* of the holding table 20. Therefore, the angle of the rotation axis 20*a* of the holding table 20 can be adjusted to an arbitrary angle by the inclination angle adjuster 30.

In FIG. 2, the inclination angle adjuster 30 on the side of the movable support part 25*c* is shown. The inclination angle adjuster 30 on the side of the movable support part 25*c* also has the same configuration and the inclination angle adjusters 30 of both the movable support parts 25*b* and 25*c* are formed symmetrically with each other with respect to a line L shown in FIG. 3, which passes through the rotation axis 20*a* of the holding table 20 (rotation center 1*a* of the plate object 1) and the fixed support part 25*a*.

As shown in FIG. 2, the inclination angle adjuster 30 includes a motor 32 fixed to the lower surface of the apparatus pedestal 29, a driven bolt 33 that penetrates the apparatus pedestal 29 in a screwed manner and is rotationally driven by the motor 32, an adjustment lever 35 that is swingably supported over the apparatus pedestal 29 with the intermediary of a fulcrum block 34 and has a swing tip part supported by the upper end part of the driven bolt 33, and an adjustment block 36 that is supported by the adjustment lever 35 and is fixed to the flange part 25 in a penetrating manner (refer to Japanese Patent Laid-open No. 2008-264913).

In the adjustment lever 35, a fulcrum part 35*a* as the base end is fixed to the fulcrum block 34 and a point-of-effort part 35*c* as the swing tip part is supported by the upper end part of the driven bolt 33. Furthermore, the adjustment block 36 is supported on a point-of-load part 35*b* between the fulcrum part 35*a* and the point-of-effort part 35*c*. At the end part of the adjustment lever 35 on the side of the fulcrum part 35*a*, an elastic neck part 33*d* with a semicircular arc shape that is upward convex is formed. The driven bolt 33 advances upward and retreats downward by actuation of the motor 32. When this vertical movement is transmitted to the point-of-effort part 35*c*, the elastic neck part 33*d* is distorted, which vertically swings the adjustment lever 35.

Figure 4A:
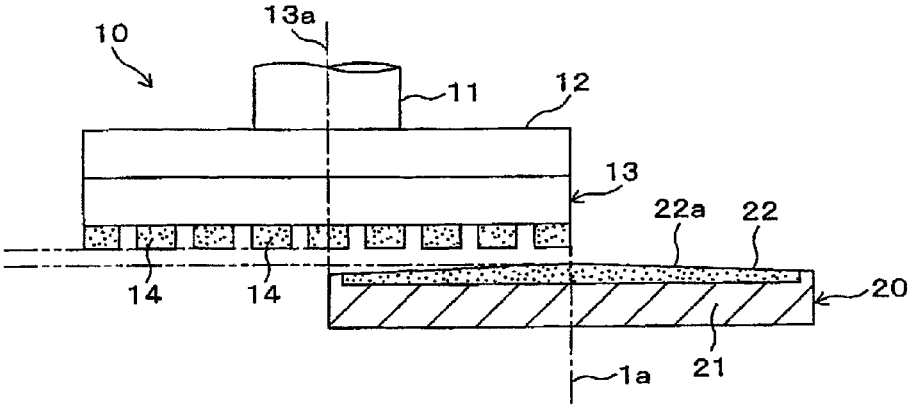
FIG. 4A is a partial sectional side view showing the positional relationship between the grinding wheel and the holding table in the state in which the rotation axis line of the grinding wheel is parallel to the rotation axis line of the holding table.

When the adjustment lever 35 swings in this manner, the adjustment block 36 supported on the point-of-load part 35*b* vertically moves. This vertically moves the respective movable support parts 25*b* and 25*c* of the flange part 25. As a result, the rotation axis 20*a* of the holding table 20 inclines with the fixed support part 25*a* serving as the fulcrum, and the holding table 20 tilts in association with the inclination. When three points of the fixed support part 25*a* and the respective movable support parts 25*b* and 25*c* are at the same height level, the rotation axis 20*a* of the holding table 20 is parallel to a rotation axis 13*a* of the grinding wheel 13 extending along the vertical direction as shown in FIG. 4A.

Figure 4B:
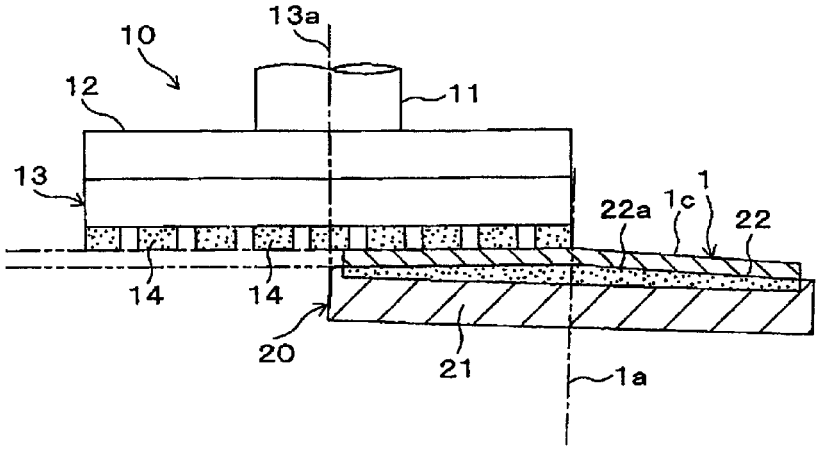
FIG. 4B is a partial sectional side view of the state in which a holding surface of the holding table is parallel to a grinding surface of the grinding wheel in a processing region.

As shown in FIG. 3, the processing region 15 for the plate object 1 by the grinding stones 14 ranges from the rotation center 1*a* of the plate object 1 to the fixed support part 25*a*. If the inclination angle of the holding table 20 is so adjusted that, in this processing region 15, the grinding stones 14 become parallel to the holding surface 22*a* of the part opposed to the grinding stones 14 as shown in FIG. 4B and the plate object 1 is ground in this state, the plate object 1 is ground into a flat shape with a uniform thickness.

[2] Processing Method

Next, a processing method of the present invention to flatly process the plate object 1 by using the above-described grinding apparatus will be described.

[2-1] Shape-after-Etching Check Step

As described above, for the plate object 1, after the grinding-target surface 1*c* is ground, etching is performed for the grinding-target surface 1*c* by a predetermined method in order to eliminate grinding distortion generated by the grinding. However, in some cases, the etching surface of the plate object 1 does not become flat because of variation in the etching rate. So, in the present embodiment, first a shape-after-etching check step is carried out in which etching is performed for the grinding-target surface 1*c* of the flat plate object 1 and the shape of the plate object 1 after the etching is checked.

In the shape-after-etching check step, after the plate object 1 is flatly ground as shown in FIG. 4B to obtain the flat plate object 1, etching is performed for the grinding-target surface 1*c* of this plate object 1 by a predetermined method. Because the plate object 1 changes from the flat shape to a shape according to the etching rate, the height position of the etching surface is measured at plural points to check the sectional shape. As the measurement points of the height position, plural positions equally separated from each other along the diameter are employed. Specific examples of the method for checking the height position of the etching surface include the following method. Specifically, in this method, a contactless thickness detector disposed lateral to the holding table 20 is moved in a circular arc manner in a one-side radius region from the center of the plate object 1 to the outer circumferential part in such a manner as to pass through the center of the plate object 1, and the height position is measured at three points on the trajectory of this movement. Then, the overall sectional shape is calculated with the opposite-side radius region deemed to have a symmetrical shape.

Figure 5:
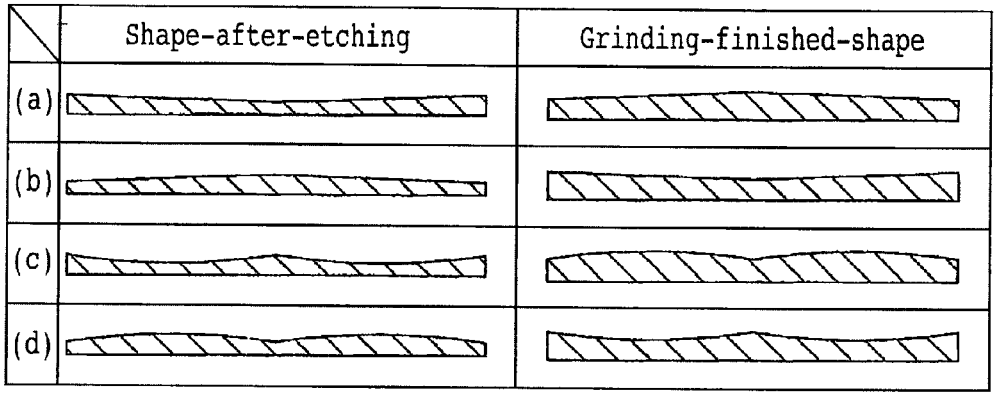
FIG. 5 is a diagram showing the shapes of the plate object after etching by different etching methods (a) to (d) and preferred grinding-finished shapes corresponding to these shapes after etching.

FIG. 5 shows four patterns (a) to (d) of the sectional shape of the plate object 1 after etching due to difference in the etching method, and the shapes are as follows.

(a) center-concave shape in which the center is the thinnest and the thickness gradually becomes larger in the direction toward the outer circumferential edge (b) center-convex shape in which the center is the thickest and the thickness gradually becomes smaller in the direction toward the outer circumferential edge (c) double-concave shape in which the periphery of the center has a concave shape (d) double-convex shape in which the periphery of the center has a convex shape Such difference in the etching rate is generated depending on the kind of etchant, the method, and so forth. For example if etching is performed by spin coating in which an etchant is dropped onto the center of the plate object 1 with the plate object 1 spun, when the etching reaction rate is high, the shape of the plate object 1 becomes the center-concave shape because the etching starts from the center. When the etching reaction rate is low, the outer circumferential part, where the amount of supply of the etchant is relatively larger, is etched at a higher degree and thus the shape easily becomes the center-convex shape.

[2-2] Grinding-Finished-Shape Calculation Step

Subsequently, a grinding-finished-shape calculation step is carried out in which a grinding-finished shape that makes the plate object 1 become flat after the etching step is calculated based on the shape of the plate object 1 after the etching checked in the shape-after-etching check step. In this grinding-finished-shape calculation step, a shape obtained by inverting the shape after etching obtained in the shape-after-etching check step to the reverse shape is coupled with the amount of etching removal to be calculated as the grinding-finished shape. Therefore, for the shapes after etching (a) to (d) shown in FIG. 5, grinding-finished shapes shown on the right side in FIG. 5 are calculated. Specifically, the grinding-finished shapes for the shapes after etching (a) to (d) are as follows.

(a) center-convex shape in which the center is the thickest and the thickness gradually becomes smaller in the direction toward the outer circumferential edge (b) center-concave shape in which the center is the thinnest and the thickness gradually becomes larger in the direction toward the outer circumferential edge (c) double-convex shape in which the periphery of the center has a convex shape (d) double-concave shape in which the periphery of the center has a concave shape

[2-3] Grinding Step

Next, the grinding-target surface 1*c* of the plate object 1 is ground by the grinding apparatus of FIG. 1 to perform thinning processing to a predetermined thickness. In the grinding step, first, the inclination angle of the holding table 20 is adjusted to the state of the parallel setting so that the holding surface 22*a* may become parallel to the grinding stones 14 in the processing region 15 as shown in FIG. 4B. Subsequently, the plate object 1 is sucked and held on the holding surface 22*a* of the holding table 20 with the intermediary of the protective component 5. Then, from the state of the parallel setting, the holding table 20 is properly inclined corresponding to the predetermined etching method so that the grinding-finished shape calculated in the grinding-finished-shape calculation step may be obtained, to set the grinding surface 14*a* of the grinding stones 14 and the plate object 1 in the processing region 15 to a non-parallel state. In this state, grinding is performed with the grinding stones 14 made to abut against the plate object 1 to form the plate object 1 into a non-flat shape.

Figure 6A:
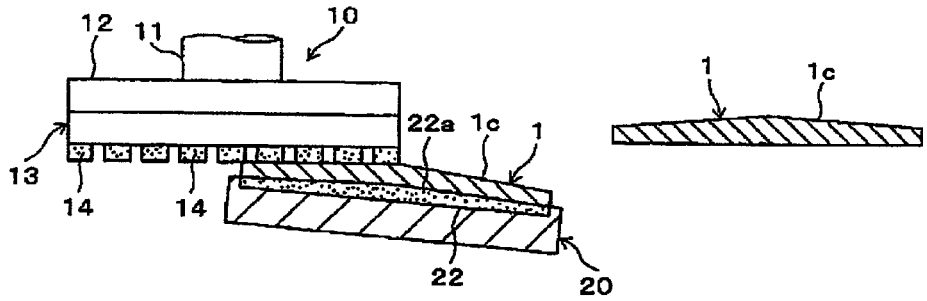
FIGS. 6A to 6D include left-side sectional views showing the grinding step for grinding the plate object into the grinding-finished shapes of (a) to (d) shown in FIG. 5 and right-side sectional views showing the plate object after the grinding.

The grinding methods when the grinding-finished shape is the above-described shapes (a) to (d) will be described below. When the grinding-finished shape calculated in the grinding-finished-shape calculation step is the "center-convex shape in which the center is the thickest and the thickness gradually becomes smaller in the direction toward the outer circumferential edge" of FIG. 5(*a*), from the state of the above-described parallel setting, the holding table 20 is tilted in the direction of an arrow (a) along the plane formed by the above-described line L shown in FIG. 1 and the rotation axis 20*a* of the holding table 20. For example, to form the plate object 1 into a center-convex shape in which the center is higher than the outer circumferential edge by 2 μm, two movable support parts 25*b* and 25*c* are evenly so lowered that, in FIG. 3, a point C as the rotation center 1*a* of the plate object 1 becomes lower by 2 μm than a point A at the outer circumferential edge close to the fixed support part 25*a*. FIG. 6A shows the state in which the plate object 1 is being ground with the holding table 20 tilted in this manner, and the plate object 1 is ground into the center-convex shape by this grinding.

Figure 6B:
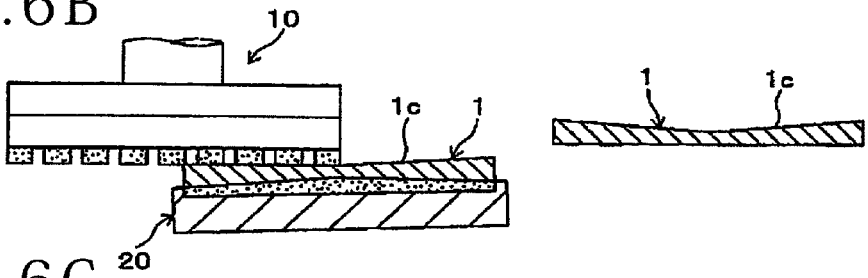

When the grinding-finished shape calculated in the grinding-finished-shape calculation step is the "center-concave shape in which the center is the thinnest and the thickness gradually becomes larger in the direction toward the outer circumferential edge" of FIG. 5(*b*), from the state of the above-described parallel setting, the holding table 20 is tilted in the direction of an arrow (b) along the plane formed by the above-described line L shown in FIG. 1 and the rotation axis 20*a* of the holding table 20. For example, to form the plate object 1 into a center-concave shape in which the center is lower than the outer circumferential edge by 2 μm, two movable support parts 25*b* and 25*c* are evenly so raised that the point C at the rotation center of the plate object 1 becomes higher by 2 μm than the point A in FIG. 3. FIG. 6B shows the state in which the plate object 1 is being ground with the holding table 20 tilted in this manner, and the plate object 1 is ground into the center-concave shape by this grinding.

Figure 6C:
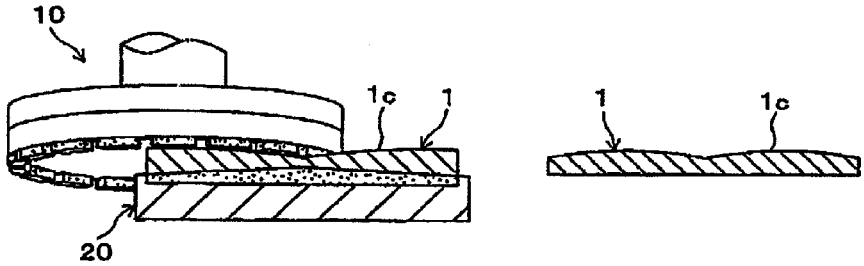

When the grinding-finished shape calculated in the grinding-finished-shape calculation step is the "double-convex shape in which the periphery of the center has a convex shape" of FIG. 5(*c*), from the state of the above-described parallel setting, the holding table 20 is tilted in the direction of an arrow (c) along the plane perpendicular to the plane formed by the above-described line L shown in FIG. 1 and the rotation axis 20*a* of the holding table 20. That is, the holding table 20 is so adjusted that, in FIG. 3, a point B close to the middle position in the processing region 15 becomes lower than the points A and C. FIG. 6C shows the state in which the plate object 1 is being ground with the holding table 20 tilted in this manner. The periphery of the center of the plate object 1 is ground by the inner circumferential edge of the grinding surface 14*a* of the grinding stones 14 and thereby the plate object 1 is ground into the double-convex shape.

Figure 6D:
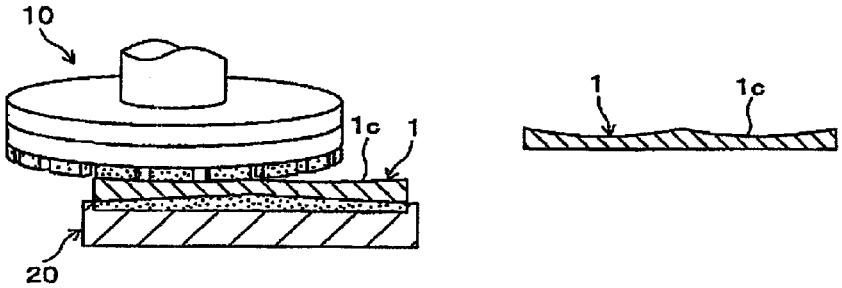

When the grinding-finished shape calculated in the grinding-finished-shape calculation step is the "double-concave shape in which the periphery of the center has a concave shape" of FIG. 5(*d*), from the state of the above-described parallel setting, the holding table 20 is tilted in the direction of an arrow (d) along the plane perpendicular to the plane formed by the above-described line L shown in FIG. 1 and the rotation axis 20*a* of the holding table 20. That is, the holding table 20 is so adjusted that, in FIG. 3, the point B close to the middle position in the processing region 15 becomes higher than the points A and C. FIG. 6D shows the state in which the plate object 1 is being ground with the holding table 20 tilted in this manner. The periphery of the center of the plate object 1 is ground by the outer circumferential edge of the grinding surface 14*a* of the grinding stones 14 and thereby the plate object 1 is ground into the double-concave shape. FIGS. 6C and 6D are made as drawings in which the grinding stones 14 are relatively inclined in order to show the inclination state of the grinding stones 14 abutting against the grinding-target surface 1*c*.

[2-4] Etching Step

Figure 7:
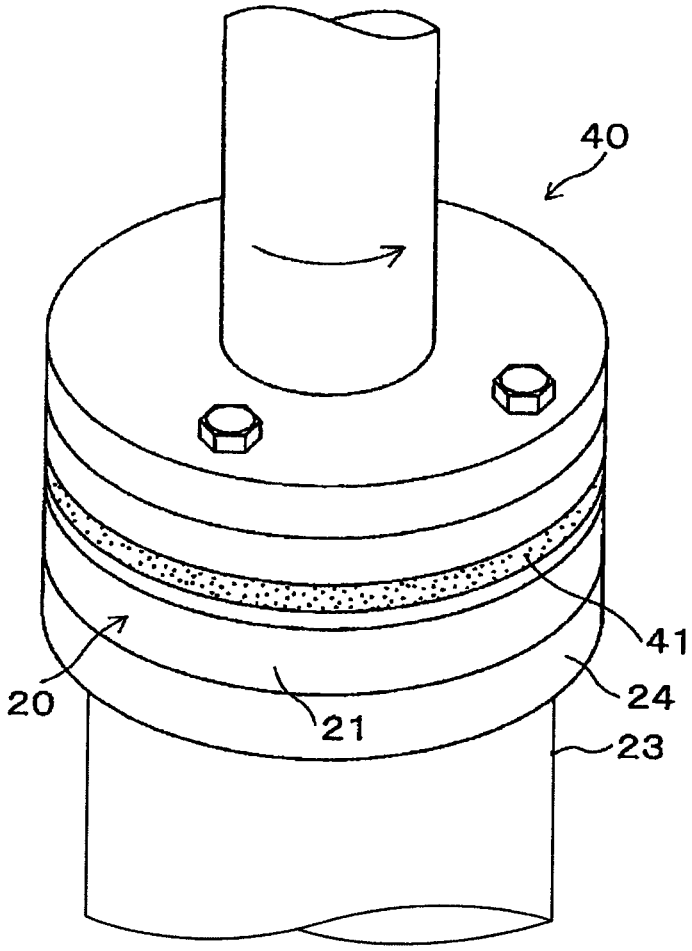
FIG. 7 is a perspective view showing one example of an etching step.

When the grinding step in which grinding into the grinding-finished shape corresponding to a predetermined etching method is performed in the above-described manner is ended, etching of the grinding-target surface 1*c* of the plate object 1 is performed by this predetermined etching method. Examples of the etching include wet etching by the above-described spin coating, dry etching such as plasma etching, and CMP (Chemical-Mechanical Polishing) etching. In the case of performing CMP etching, the holding table 20 of the grinding apparatus is diverted as shown in FIG. 7 if possible. The plate object 1 ground into a predetermined grinding-finished shape is held on this holding table 20 and is rotated and the CMP etching is performed while an abrasive 41 of a polishing unit 40 that rotates is pressed against the grinding-target surface 1*c*.

[3] Operation and Effect of Embodiment

According to the above-described embodiment, the shape of the plate object 1 resulting from etching by a predetermined etching method is grasped in advance by carrying out the shape-after-etching check step. In the grinding step, the plate object 1 is ground into a grinding-finished shape as a non-flat shape obtained by inverting the shape after etching to the reverse shape. This allows the plate object 1 after the etching step to be formed into a flat shape with a uniform thickness.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A method for processing a plate object, the method comprising the steps of:

performing pre-etching for a grinding-target surface of a first plate object that is flat prior to the pre-etching;

checking a shape of the first plate object after the pre-etching;

obtaining a grinding-finished-shape of a second plate object by inverting the shape of the first plate object after the pre-etching to the reverse shape;

grinding the second plate object held by a holding table having a holding surface to hold the second plate object by a grinding unit having a grinding stone to thin the second plate object to a predetermined thickness having the grinding-finished-shape obtained; and etching a grinding-target surface of the second plate object after carrying out the grinding.

2. The method for processing a plate object according to claim 1, wherein in the grinding, the second plate object is formed into the non-flat shape by performing grinding while making the grinding stone abut against the second plate object held by the holding table in a state in which the holding surface of the holding table that holds the second plate object and a grinding surface of the grinding stone are relatively inclined to be set non-parallel to each other.

3. The method for processing a plate object according to claim 1, wherein the first and the second plate object each has a circular disc shape and a sectional shape of the first plate object checked in the checking is either a double-concave shape in which the periphery of the center of the first plate object has a concave shape or a double-convex shape in which the periphery of the center of the first plate object has a convex shape, the sectional shape of the second plate object is so formed as to become the double-convex shape in which the periphery of the center of the second plate object has a convex shape in the grinding, if the sectional shape of the first plate object checked in the checking is the double-concave shape in which the periphery of the center of the first plate object has a concave shape, and the sectional shape of the second plate object is so formed as to become the double-concave shape in which the periphery of the center of the second plate object has a concave shape in the grinding, if the sectional shape of the first plate object checked in the checking is the double-convex shape in which the periphery of the center of the first plate object has a convex shape.

* * * * *